United States Patent [19]

Emerson

[11] Patent Number: 4,560,166

[45] Date of Patent: Dec. 24, 1985

[54] GOLFER'S HEAD MOVEMENT INDICATING DEVICE

[76] Inventor: Edwin E. Emerson, 106 Pike St., East, Osakis, Minn. 56360

[21] Appl. No.: 675,415

[22] Filed: Nov. 27, 1984

[51] Int. Cl.[4] ..... A63B 69/36

[52] U.S. Cl. ..... 273/183 B; 2/209.1

[58] Field of Search ..... 273/183 B, 183 E, 190 A; 2/209.1, 209.2

[56] References Cited

U.S. PATENT DOCUMENTS 675,700 6/1901 Zimmermann ..... 2/209.1 X 3,169,022 2/1965 Kretsinger ..... 273/183 B 3,362,023 1/1968 McMahon ..... 273/183 B

*Primary Examiner*—George J. Marlo

[57] ABSTRACT

This invention is a golf player's cap fitted with an electrical circuit; the circuit including a microphone, an audible alarm, a momentum switch and an inhibitor switch. If the golfer's head is moved during the club swing and before the ball is struck, the momentum switch closes for an instant and the alarm sounds for two to three seconds. If the golf ball is struck before the golfer's head is moved, the microphone, which is aimed at the golf ball to be struck, picks up the sound of the golf club striking the ball and actuates the inhibitor switch, which prevents the alarm from being sounded.

1 Claim, 4 Drawing Figures

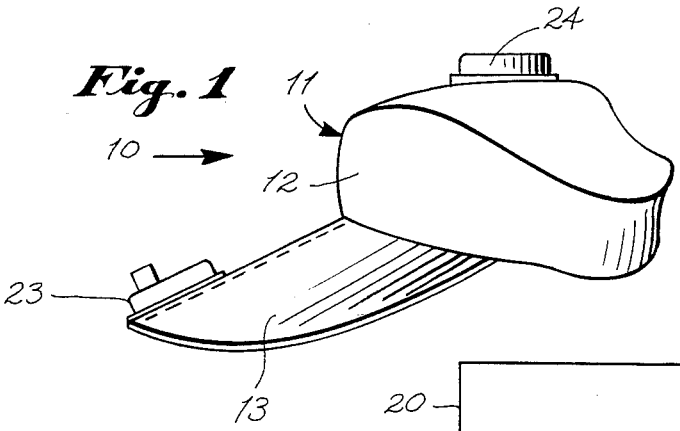
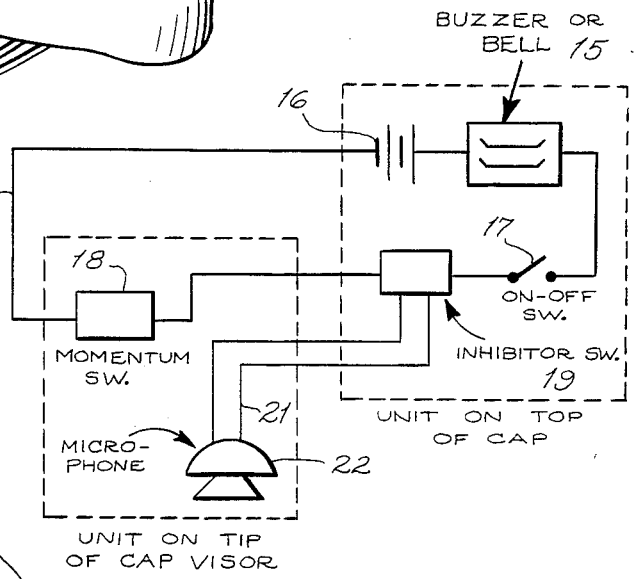
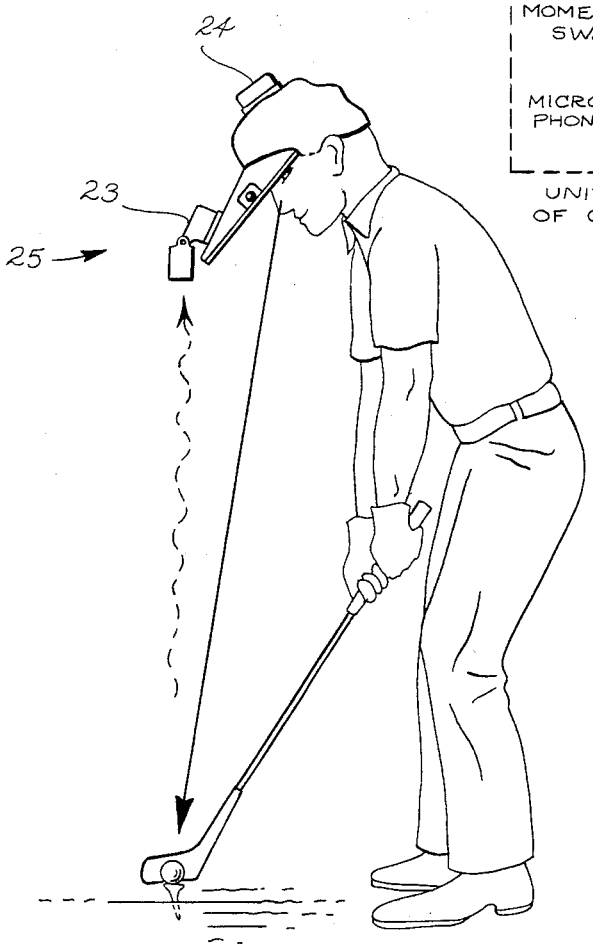
Fig. 3
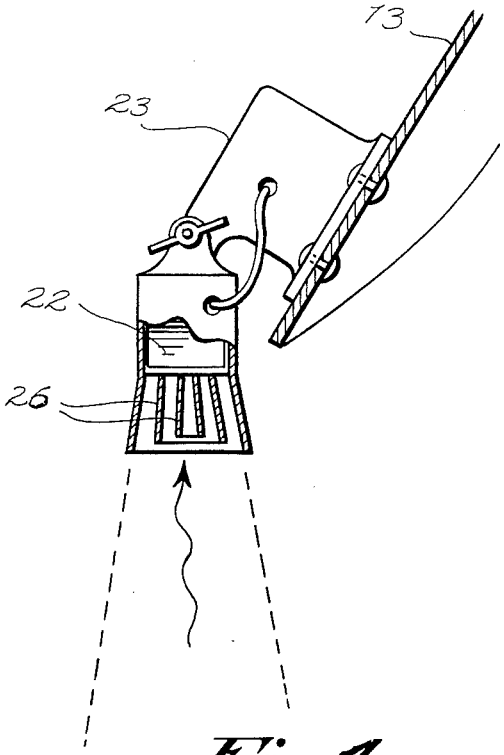
Fig. 4

GOLFER'S HEAD MOVEMENT INDICATING DEVICE

This invention relates generally to golf accessories. More specifically, it relates to headgear for golf players. Still more specifically, it realtes to training devices for playing the game of golf.

It is well known, to those persons who have tried playing golf that they must learn to address a ball properly, so that it can be accurately driven in direction. To a novice, it seems perfectly natural to turn the head along with the body when swinging the club to strike the ball. However, the experienced player knows that he must hold his head steady, and keep his eyes on the ball standing in front of him throughout the full swing, so that it is accurately driven. Considerable practice is generally needed, in order to learn doing this correctly, and usually under the guidance of an observing golf instructor. Even the seasoned player may, at times, need to be retrained not to move his head during the golf club swing.

Accordingly, it is a principal object of the present invention to provide a golf training device, which will notify a golf player if he has moved his head before hitting the ball, so that he can then try to overcome this objectionable practice, and learn to play a better game.

Other objects are to provide a golf training device which is simple in design, inexpensive to manufacture, rugged in construction, easy to use, and efficient in operation.

These, and other objects, will be readily evident, upon a study of the following specification, and the accompanying drawing, wherein:

FIG. 1 is a side elevational view of a golfer's cap, shown including the invention installed thereupon;

FIG. 2 is an electrical circuit of the invention;

FIG. 3 is a side elevational view of a modified design of the invention, shown being worn by a golf player when hitting a ball, and FIG. 4 is an enlarged detail thereof, and showing the microphone being behind a baffle grill, so that sound waves only from a struck ball are picked up, and all other stray sounds are excluded.

Referring now to the drawing in greater detail, and more particularly to FIGS. 1 and 2 thereof, at this time, the reference numeral 10 represents a golf training device, according to the present invention, wherein there is a conventional-appearing golf player's cap 11, comprising a headpiece 12 for fitting on a head, and a visor 13 at its front, for shielding the eyes from sunlight.

In the present invention, an electrical circuit 14 is installed on the cap, and which is automatically activated when the head is moved, so as to notify the player of this movement.

The circuit includes a warning bell or buzzer 15, a replaceable dry cell battery 16, an on-off switch 17, a momentum switch 18, and an inhibitor switch 19, all of which are wired in a single series circuit 20; and the inhibitor switch being also in a second circuit 21 with a microphone 22.

The momentum switch and the microphone are installed, as a single unit 23, at the tip of the visor, while the rest of the components are installed, as a single unit 24, upon the top of the cap headpiece.

The operation of the device is as follows:

Only the swift head movement during the golf stroke activates the momentum switch, and that only for an instant.

Ordinary head motions between strokes do not activate the momentum switch. Accordingly, the device need not be turned off between strokes.

If the head is moved during the stroke before the ball is struck, then the momentum switch closes for an instant and the alarm sounds for two to three seconds. This indicates a bad stroke.

If the ball is struck before the head is moved, then the striking sound is received by the microphone and the alarm circuit is inhibited. Thus, the striking sound prevents the alarm from being sounded. This indicates a good stroke.

In FIG. 4, the microphone 22 is shown being behind a baffle grill 26, so that sound waves only from the struck ball are picked up by the microphone, while all other stray sounds are excluded.

While various changes may be made in the detail construction, it is understood that such changes will be within the spirit and scope of the present invention, as is defined by the appended claims.

What I claim as new, is:

1. A golf training device, comprising, in combination, a cap for being worn on a golf player's head, and an electric warning circuit installed on said cap, for indicating if said player's head was moved before or after a golf club has struck a golf ball; said warning circuit comprising an audible sound system that includes a unit mounted on a top of said cap and a unit mounted on a tip of a visor of said cap, said unit on said cap top including a battery, a buzzer, an on-off switch and an inhibitor switch in a single series circuit, said unit on said visor tip comprising a momentum switch in said series circuit and also including a microphone in a secondary circuit with said inhibitor switch, said microphone having a plurality of concentric baffles forming a grill in front thereof.

* * * * *